United States Patent [19]

Zanobini

[11] Patent Number: 4,513,813

[45] Date of Patent: Apr. 30, 1985

[54] AIR-COOLED STEAM CONDENSER

[75] Inventor: Alessandro Zanobini, Florence, Italy

[73] Assignee: Nuovo Pignone S.p.A., Florence, Italy

[21] Appl. No.: 344,634

[22] Filed: Feb. 1, 1982

[30] Foreign Application Priority Data

Feb. 18, 1981 [IT] Italy ..... 19823 A/81

[51] Int. Cl.[3] ..... F28B 1/00; F28B 3/00; F28B 9/10; F24B 1/06

[52] U.S. Cl. ..... 165/111; 165/110; 165/DIG. 1; 165/DIG. 24; 165/124

[58] Field of Search ..... 165/110, 111, DIG. 1, 165/DIG. 18, 144, 145, 163, 172, 173, 176, DIG. 24, 124

[56] References Cited

U.S. PATENT DOCUMENTS

| | | | |
|---|---|---|---|
| 1,817,948 | 8/1931 | Smith | 165/163 |
| 2,401,918 | 6/1946 | Elder et al. | 165/145 |
| 3,424,235 | 1/1969 | Schoonman | 165/110 |
| 3,814,177 | 6/1974 | Harris et al. | 165/DIG. 1 |
| 3,835,920 | 9/1974 | Mondt | 165/176 |
| 3,887,002 | 6/1975 | Schoonman | 165/DIG. 1 |
| 4,196,157 | 4/1980 | Schinner | 165/DIG. 1 |
| 4,202,405 | 5/1980 | Berg | 165/111 |
| 4,232,729 | 11/1980 | Ingram et al. | 165/DIG. 1 |

FOREIGN PATENT DOCUMENTS

| | | | |
|---|---|---|---|
| 71419 | 11/1913 | Austria | 165/176 |
| 2018823 | 6/1970 | France | 165/111 |
| 588062 | 5/1947 | United Kingdom | 165/DIG. 1 |

*Primary Examiner*—William R. Cline
*Assistant Examiner*—John K. Ford
*Attorney, Agent, or Firm*—Hedman, Gibson, Costigan & Hoare

[57] ABSTRACT

In an air-cooled steam condenser (2, 2'), each tube of a bundle (8, 8') of finned heat exchange tubes, arranged parallel to each other and horizontally, and connecting a steam dispensing manifold (4, 4') to an outlet manifold (5, 5'), is in the form of a coil including three finned elements (12, 13, 14) which are arranged horizontally and parallel to each other in consecutive rows relative to the direction of the cooling air flow (11, 11'), and which are connected together by two elbow fittings (15, 16) positioned at an angle with a positive slope so as to facilitate the drainage of the condensate.

2 Claims, 3 Drawing Figures

AIR-COOLED STEAM CONDENSER

This invention relates to an air-cooled condenser for condensing vapor, especially water vapor, and particularly to an efficient air-cooled steam condenser which suppresses backflow and inhibits the formation of ice therein.

In recent years, the air-cooling of fluids has assumed an everincreasing importance as compared to conventional water-cooling, due to the evergrowing difficulty in obtaining adequate water supplies and to the problem of thermal and biological pollution caused by the use of water.

One of the fields in which air cooling is most frequently adopted is the condensation of steam from turbines, where, in order to improve the efficiency of the turbine, the condensation must be quite complete and must be carried out at subatmospheric pressures.

However, since the air which always accompanies the steam entrains the steam whereby the latter would be discharged into the atmosphere, it is necessary, in order drastically to reduce the loss of steam entrained by air, to carry out particularly extensive cooling. This is difficult, especially when the ambient conditions include subzero temperatures. The lower the ambient temperature, the more difficult is the cooling. In fact, under such conditions, the temperature in the interior of the condenser may drop to values near to those of the ambient air, the result being the formation of ice in the condenser.

With the lapse of time, this ice may grow and obstruct the free passageway of the steam through the tubes of the condenser, thereby rendering it inoperative.

In the most typical known air-cooled condenser, the fluid or vapor to be condensed is caused to flow through superposed rows of finned heat exchange tubes which are all fed by a common dispensing manifold and which all drain to a single common manifold in which the condensate is collected. A stream of cooling air impinges onto the external surfaces of the tubes, in crossflow, the stream of cooling air being driven by blowers between the superposed rows of tubes. The air flows between the rows sequentially and it is thus apparent that more vapor will condense in the first row (on which the air initially impinges and which is consequently contacted by the coolest air) than in the remaining rows, the condensing ability gradually decreasing as the air contacts the other rows of tubes of the condenser.

In other words, the mass of steam that condenses in each row of finned heat exchange tubes is proportional to the temperature differential between the saturated steam and the cooling air impinging on the row, so that more steam will condense in the first row than in the second row, and so forth. This more efficient heat exchange in the first row leads (as has been ascertained in practice and as has been expressed quantitatively in mathemetical terms) to the suction of steam from the other rows of tubes (the less efficient ones) into the tubes of the first row. In other words, the steam which is present in the condensate collection manifold is condensed because it has not been condensed in the top rows. Summing up, steam will initially enter the first row of tubes at both ends, but the steam flowing through the first row of tubes in the exit end of the tubes, in a direction opposite to that of the main stream, is rich in uncondensable gases such as air, so that these gases accumulate in the end portion of the tubes of the first row, thus permitting the condensate to drain into its collection manifold, but preventing other steam from coming from the manifold and from continuing to heat the condensate by its latent heat. This phenomenon is known as "backflow" whereas the resultant accumulation of uncondensable gas, that is air, is called "blanketing", and the result thereof is the serious disadvantage that the condensing ability of the first row of tubes is rendered poorer and poorer until it is virtually nil. The drawback is further aggravated in the case of cold climates, since the unactivated portion of the tubes of the first row reduces in its temperature to the ambient temperature, the consequence being that the condensate flowing through the tubes may freeze and thus form ice in the tubes.

There are known a number of air-cooled condensers in which an attempt has been made to overcome the disadvantages arising from backflow and freezing phenomena. One of the most widely known condensers is the so-called "Vent Condenser" in which only a portion of the condensation (75% to 90%) is effected in a so-called primary condenser, wherein steam and condensate flow co-currently from top to bottom, whereas the remaining steam is condensed in a subsequent reflow secondary condenser, consisting of finned vertical or sloping tubes wherein steam flows from bottom to top in countercurrent flow relative to the condensate formed. The operability of such a condenser is based on two fundamental ideas, namely (a) the avoidance of total condensation in a single primary condenser (which condensation might cause both backflow and freezing) and (b) the use, for the condensation in the secondary condenser, of a reflow condensation, which encourages condensation of the residual steam. However, such a conventional condenser, in addition to having a high cost and a large bulk, also has a number of further disadvantages. Firstly, the distribution of the condensation between the primary and the secondary condensers, with a view to preventing backflow and the consequential blanketing, is dependent on the working conditions so that a compromise is necessary between the various possible working parameters. This compromise may prove inadequate for particularly critical operational conditions. In addition, as the ambient temperature drops, the amount of condensation carried out in the secondary condenser must be increased so as to prevent freezing. Consequently, the surface of the secondary condenser should be increased (by up to 50%), and the result is not only an increase in cost but also the risk of entrainment of the condensate increases and the pressure drop increases so that the condensation temperature is far from being satisfactory. Lastly, a further disadvantage of the condenser is its poor adaptability to abrupt variations of load, so that, if the rate of flow of steam increases, a large amount of steam reaches the secondary condenser before the regulation system can act on the blowers, and the secondary condenser is incapable of handling this amount of steam. The result is a detrimental, sudden and abrupt rise of the condensation pressure.

In another type of conventional condenser, backflow is not prevented by distributing the condensation, as in the former case, between two serially arranged condensers, but by causing each row of heat exchange tubes of the condenser to drain into a respective collecting manifold. This type of condenser does not have the drawbacks described above, but the condenser is very large and expensive because, in addition to a large number of collecting manifolds, as many ejectors and attendant conduits are required.

It is desirable to overcome the disadvantages described above by providing an air-cooled condenser in which reduced costs and bulk are combined with a high efficiency, even if the condenser is used in very cold climates.

According to the present invention, a single dispensing manifold for the vapor to be condensed and a single outlet manifold for collecting the condensate from bottom and removing the uncondensable gas from the top, are connected together by a bundle of finned heat exchange tubes arranged parallel to each other so as to obtain smooth operating conditions for all of the finned heat exchange tubes. According to a feature of the present invention, the finned heat exchange tubes of the bundle, arranged parallel to each other and horizontally, are each in the form of a coil consisting of three finned elements arranged horizontally and parallel to each other in consecutive rows relative to the direction of the cooling air stream, which direction is generally perpendicular to the bundle of tubes, the elements being connected together by two elbow fittings arranged at an angle with a positive slope to facilitate drainage of the condensate.

This constructional arrangement enables the same working conditions to occur in each coil because the elements which correspond to one another in the coil are arranged in the same way relative to the cooling air stream so that the trend of the temperature of the air is the same for all of the coils. In addition, the steam feed and the venting of uncondensable gas and of the residual steam are on opposite sides of the condenser, so that the pressure drop is balanced. The same is true of the flow of steam in each coil. Summing up, the same identical conditions apply for the fluid exiting the heat exchange tubes, whereby the occurrence of backflow, even if a single feed manifold and a single outlet manifold are used, is excluded, and whereby the condenser may have a small bulk.

As a result of the slope of the elbow fittings of each convolution of the coil, the three convolutions of each coil are staggered with respect to one another (relative to the path of the cooling air stream) so that the portion of the cooling air stream flowing between the first convolutions of the coils will impinge on the second convolutions, and the portion of the stream flowing between the second convolutions will impinge on the third convolutions, so that the maximum exploitation of the cooling air is thereby achieved.

According to a preferred embodiment of the present invention, the dispensing manifolds and the outlet manifolds are arranged at an angle and parallel to each other, the dispensing manifold being fed from the bottom whereas in the outlet manifold the condensate is drained from the bottom by gravity and the uncondensable gas together with the residual steam are removed from the top with the aid of an ejector. In this case, the efficiency of the condenser is improved since, in the outlet manifold, there is a countercurrent flow between the condensate which drains downwards and the residual steam which flows upwards, and heat is exchanged therebetween by direct contact so as to cause additional condensation of the residual steam.

According to another preferred embodiment of the present invention, the coils are connected to the dispensing manifold by that convolution which is first contacted by the cooling air stream and, consequently, are connected to the outlet manifold by that convolution which is last contacted by the cooling air stream. In other words, the flow of vapor is co-current with respect to the flow of cooling air. Such a condenser, in addition to the fact that it is not subject to backflow, also has additional protection against freezing, since the outlet convolutions of the coils are swept by air which has been heated when flowing between the other two convolutions of the coils and which is thus at a temperature well above the ambient air. The combination of these two features, namely the suppression of backflow and the fact that the outlet of the coils is contacted by heated air, thus ensures a thorough protection against the formation of ice and makes its operation easier.

The invention will now be illustrated by way of example, with reference to the accompanying drawings, in which.

Figure 1:
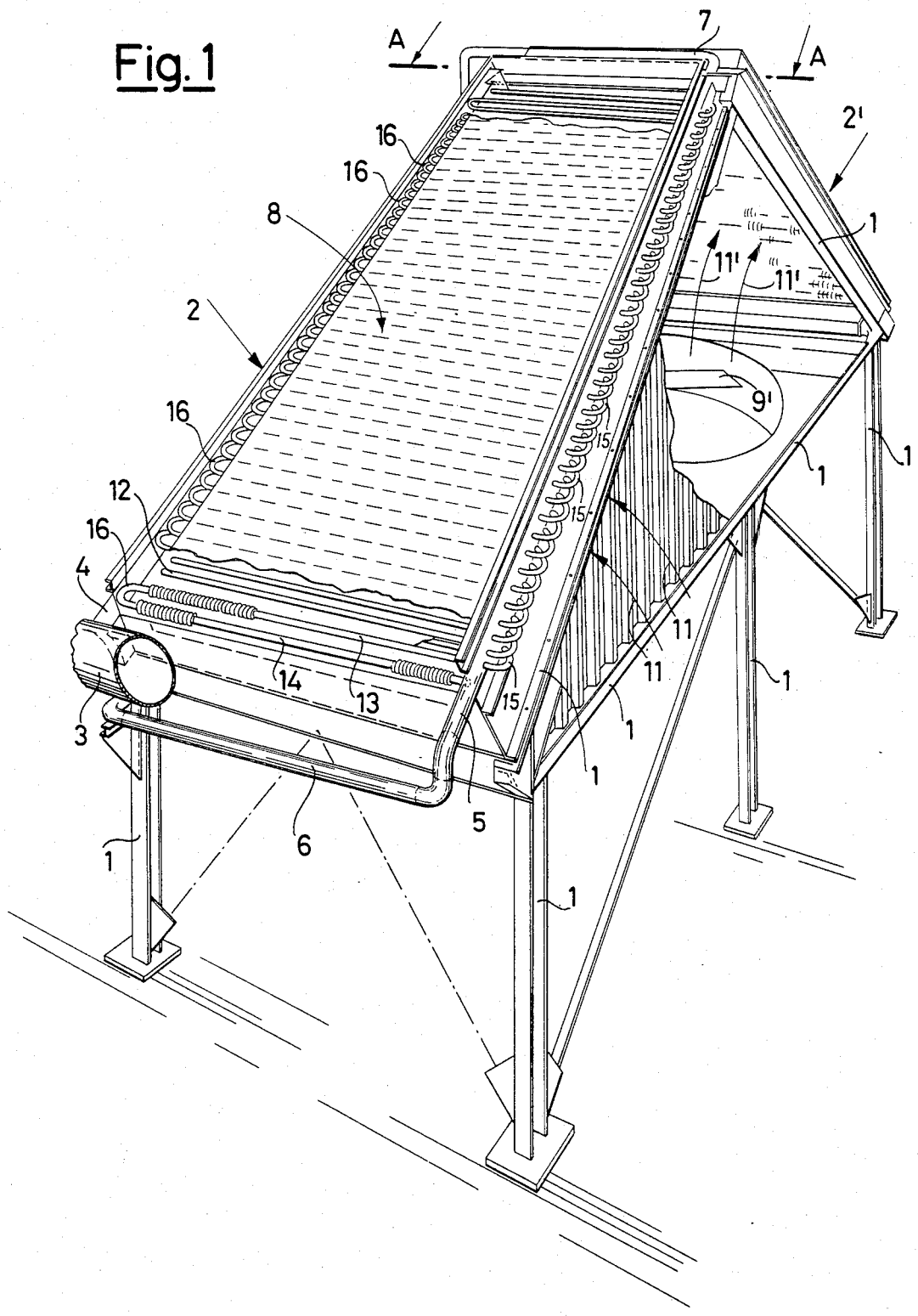
FIG. 1 is a diagrammatical perspective view, partly in cross-section, of a preferred sloping arrangement of two steam condensers according to the invention, fed by a common steam inlet.

With reference to the drawings, there is shown a scaffolding structure 1 for supporting two air-cooled steam condensers 2 and 2' according to the invention, arranged at an angle in the manner of a roof and fed by a single steam dispensing manifold 3.

Each condenser 2 and 2' comprises a respective dispensing manifold 4 or 4' for the steam to be condensed, connected to and fed from the steam dispensing manifold 3, and a respective outlet manifold 5 or 5', connected at the bottom to a respective condensate collecting manifold 6 or 6' and at the top to a respective conduit 7 or 7' for venting the uncondensable gas and the residual steam via an ejector (not shown).

Each dispensing manifold 4 or 4' is connected to the respective outlet manifold 5 or 5' by a respective bundle 8 or 8' of finned heat-exchange tubes arranged parallel to each other, with their axes horizontal. Beneath them, there is a respective blower 9 or 9', supported by the scaffolding structure 1 and driven by a respective motor 10 or 10', generating a stream of cooling air in the direction of the respective arrows 11 or 11'.

Figure 3:
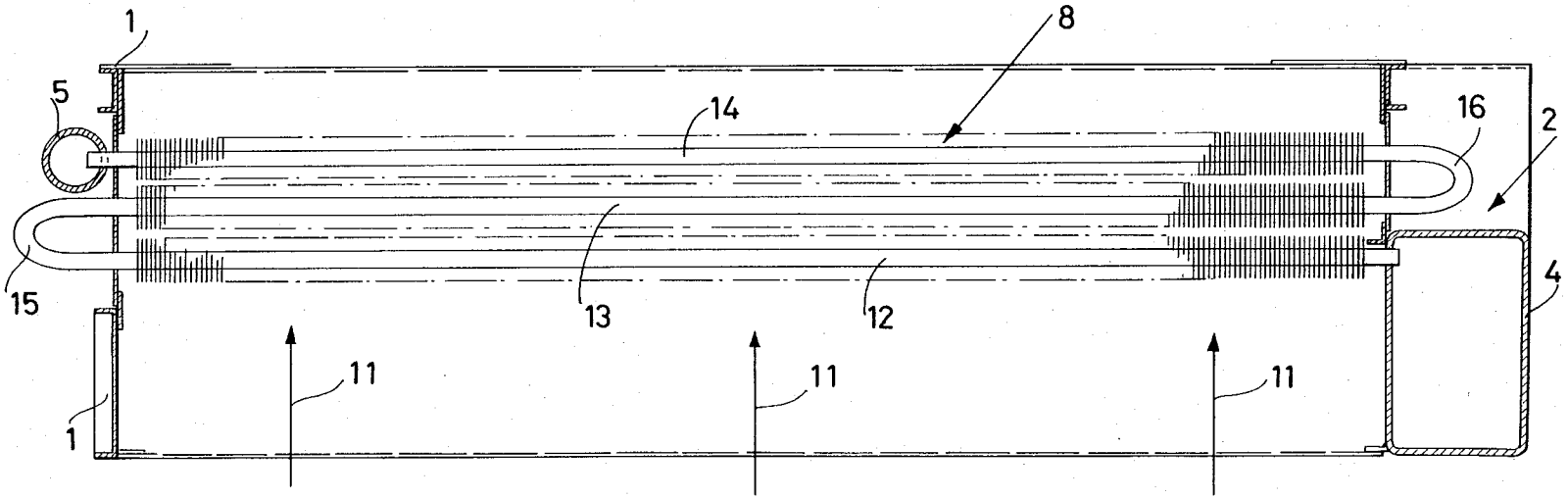
FIG. 3 is a front cross-sectional view taken along the line A—A of FIG. 1.

Each heat-exchange tube of each bundle 8 and 8' is a finned coil consisting of three convolutions 12, 13 and 14 (see FIG. 3) which are arranged horizontally and parallel to each other in consecutive rows relative to the direction 11 or 11' of the cooling air stream.

Figure 2:
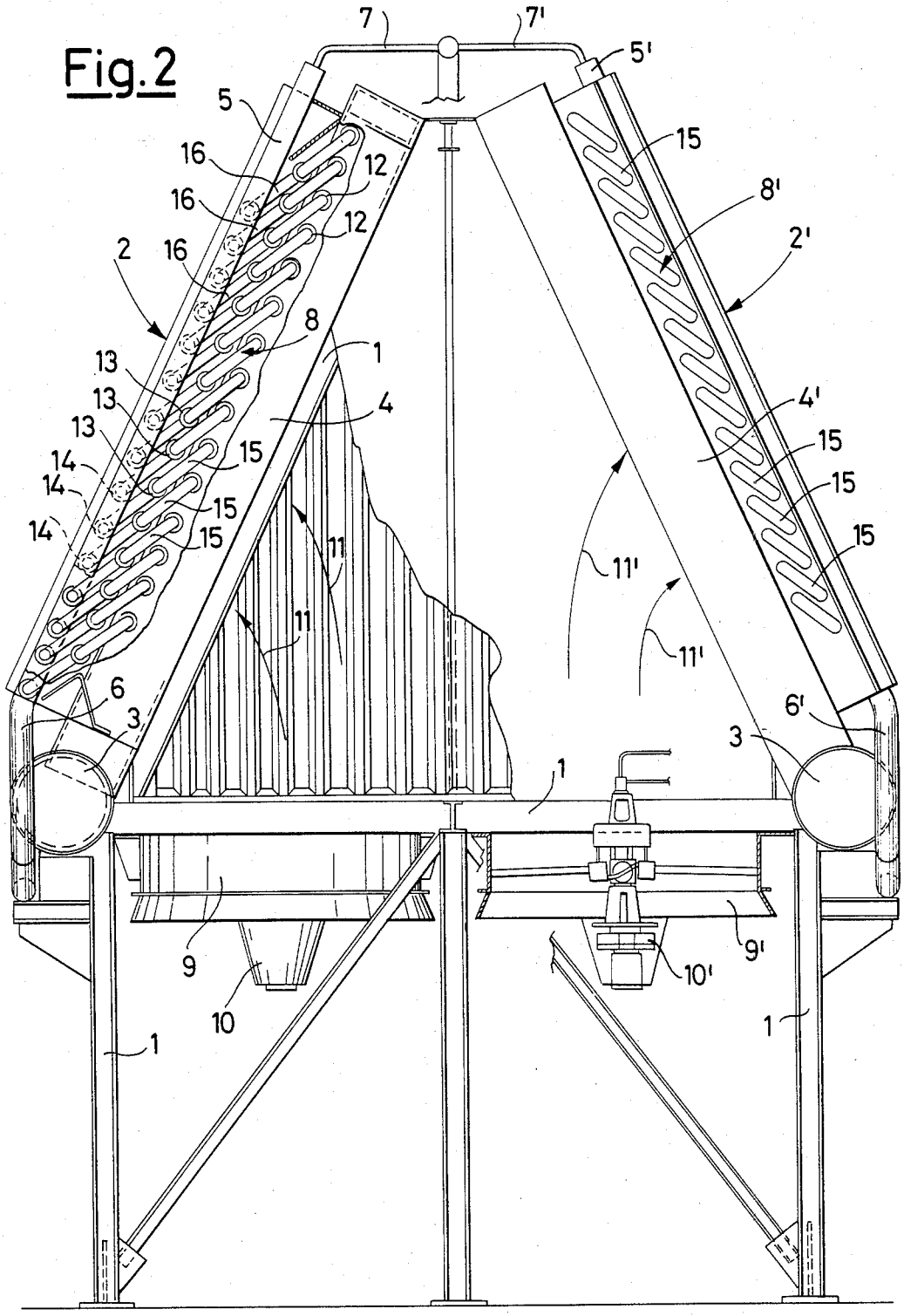
FIG. 2 is a diagrammatical side view, partly in section and on an enlarged scale, of the arrangement of FIG. 1.

The finned convolutions 12, 13 and 14 of each coil are connected together by two elbow fittings 15 and 16 which are arranged at an angle with a positive slope to encourage draining of the condensate (see FIG. 2). In the illustrated embodiment, the convolutions are in a co-current relationship with the stream 11, i.e., the finned convolution 14, which opens into the outlet manifold 5 (see FIG. 3) is in the outermost row relative to the direction of the cooling air stream, whereas the finned convolution 12, connected to the dispensing manifold 4, is the first row to be contacted by the air stream.

I claim:

1. An efficient air-cooled steam condenser which suppresses backflow and inhibits the formation of ice therein, comprising:

an inlet for steam, an inlet manifold connected at the lower end to said steam inlet for receiving and dispensing the steam, an outlet manifold spaced from said inlet manifold for collecting condensate from the steam at the bottom thereof, and a conduit connected to the top of said outlet manifold on the side of the condenser opposite that of the steam inlet for venting the uncondensed gases, said manifolds positioned at an incline and parallel to one another so that the condensate flows downwardly in said outlet manifold and the uncondensed gases flow upwardly in said outlet manifold, thereby condensing any uncondensed residual steam in the outlet manifold, an air blower positioned below said manifolds for blowing a cooling air stream upwardly and through the space between said manifolds, and a bundle of parallel, horizontal heat exchange tubes in the space between said manifolds, wherein each tube is a coil including three convolutions arranged horizontally and parallel to one another in consecutive rows relative to the direction of the cooling air stream and having a slope in the direction of said outlet manifold, and wherein each tube is connected to said inlet manifold by the convolution thereof which is the first to be contacted by said cooling air stream and to said outlet manifold by the convolution thereof which is the last to be contacted by the cooling air stream.

2. The air-cooled steam condenser of claim 1, wherein there are a pair of said condensers inclined at angles toward one another in the manner of a roof with said air blower therebelow and therebetween.

* * * * *